US005259880A

United States Patent [19]

Fujita et al.

[11] Patent Number: 5,259,880

[45] Date of Patent: Nov. 9, 1993

[54] PROJECTION MOLTEN IMPELLER FOR CONCAVE SECTION USED IN APPARATUS

[75] Inventors: Masayuki Fujita; Sueki Kubo; Hiroyuki Ito, all of Kitakyushu, Japan

[73] Assignee: Kurosaki Refractories Co., Ltd., Fukuoka, Japan

[21] Appl. No.: 731,236

[22] Filed: Jul. 17, 1991

Related U.S. Application Data

[62] Division of Ser. No. 415,230, Nov. 16, 1989, abandoned.

[30] Foreign Application Priority Data

Mar. 17, 1988 [JP] Japan ..... 63-65235

[51] Int. Cl.[5] ..... B05B 3/02; B05B 7/06; B05D 1/02; F27D 1/16

[52] U.S. Cl. ..... 118/317; 118/311; 118/323; 118/DIG. 16; 239/222.11; 264/30; 264/35; 264/269; 264/309; 425/12; 425/13; 427/236; 427/426; 427/427

[58] Field of Search ..... 264/30-36, 264/309, 269, 270, 312; 427/427, 236, 426; 118/317, 311, 300, 323, DIG. 16, DIG. 10; 239/214.25, 215, 222.11, 752, 224; 425/11-13

[56] References Cited

U.S. PATENT DOCUMENTS

| | | | |
|---|---|---|---|
| 3,034,729 | 5/1962 | Gray et al. . | |
| 4,023,781 | 5/1977 | Fritz et al. . | |
| 4,199,084 | 4/1980 | Baungartner et al. . | |
| 4,217,079 | 8/1980 | Smith et al. | 425/375 X |
| 4,440,350 | 4/1984 | Dietz et al. . | |
| 4,532,885 | 8/1985 | Nunlist . | |

FOREIGN PATENT DOCUMENTS

| | | |
|---|---|---|
| 925405 | 5/1982 | U.S.S.R. . |
| 2046887 | 11/1980 | United Kingdom . |

*Primary Examiner*—Karen Aftergut
*Attorney, Agent, or Firm*—Armstrong, Westerman Hattori, McLeland & Naughton

[57] ABSTRACT

An impeller as used in a projecting construction apparatus for a concave section of a molten-metal-discharging hole is supported on a rotating shaft for redirecting flow of impinging projection material. The impeller includes a plurality of vanes which are attached to the rotating shaft with a specified twisting angle relative to the rotating shaft. A material supplying pipe is directed upon the plurality of vanes, so that, upon impingement of the projection material upon the plurality of vanes, the projection material is projected outwardly and in a direction nearly opposite to the predetermined direction of impingement of the projection material supplied through the material-supplying pipe.

1 Claim, 5 Drawing Sheets

PROJECTION MOLTEN IMPELLER FOR CONCAVE SECTION USED IN APPARATUS

This is a division of application Ser. No. 415,230 filed Nov. 16, 1989, now abandoned.

BACKGROUND OF THE INVENTION

The present invention relates to the projecting construction method and apparatus for molten-metal-discharging holes of converter tapholes, vacuum degassing furnaces, etc., and projection impeller for concave sections used in said apparatus. The present invention has application in the repairing, constructing, and forming of a molten-metal-discharging hole by project.

BACKGROUND ART

For example, the inside wall of a converter taphole which is one example of a molten-metal-discharging hole is lined with refractory material. In proportion to its use, this refractory material gets damaged or becomes worn-out and requires repair. As a method of repairing this damage or wear in a hot state, there have been techniques such as the pressing injection repairing method, the spray repairing method, and the projection repairing method.

The above said pressing injection repairing method is a technique for filling a cylinder with flowable repairing material and pushing it out by piston, which results in a poor rate in the adhesion of repairing material onto a conically-worn-out section (also called a bell-shaped worn-out section) on the inside wall of above-said converter taphole. Even if the repairing material adheres onto the section, no usable structure forms at the repaired section.

The spray repairing method is a technique for spraying repairing material through the spraying nozzle of a spraying lance onto a section to be repaired by means of compressed air. This method has had problems that the effect in adhesion of the repairing material is poor and the structure of repaired section is also poor due to the influence of the compressed air used to transfer the repairing material if enough clearance is not secured between the spraying nozzle and the inside wall of the converter taphole.

In the case of the spray repairing method, there has been another problem that spraying onto the conically-worn-out section 10 inside the converter taphole as shown in FIG. 11 becomes impossible due to the clogging of repairing material at the bent section between the spraying lance 12 and the spraying nozzle 11, if the spraying nozzle 11, if the spraying nozzle 11 is attached to the spraying lance 12 with such on angle the repairing material may be sprayed at an acute angle (O is smaller than 90 degree).

Further, in the case of the projection repairing method, it is possible to repair the converter taphole by use of an apparatus for repairing a molten metal degassing equipment such as that disclosed in the Japanese Utility Model No. 1432690 (published in the gazette of the second publication No. 56-32513) and, as shown in FIG. 12. The repairing apparatus 17 published in above-said gazette is provided with a rotating tube 19*a* and a vertical tube 19 connected to the rotating tube 19*a* at the bottom center of the rotating impeller 18, wherein the refractory material supplied via the vertical tube 19 is ejected through the periphery of the impeller 18.

However, the case of the above-said apparatus 17 for repairing molten metal degassing equipment, there has been a problem that the refractory material is discharged only by the centrifugal force which is generated accompanying the rotation of the impeller. As a result, enough dispersing speed can not be obtained because the refractory material is supplied from the central vertical tube 19 to the rotating tube 19*a* connected to the center section of the impeller.

Another problem is that it is impossible to obtain a well-lined layer at a conically-worn-out section with a slope because the refractory material is dispersed only in the direction perpendicular to the impeller. Therefore it is difficult to disperse the refractory material perpendicularly onto the sloped conically-worn-out section.

Further, there has been a problem that the refractory material is dispersed evenly only in the radial direction. It is difficult to eject the refractory material in a limited direction and, therefore, it is difficult to efficiently repair a worn-out section generated only in a limited direction of a converter taphole. Moreover, in the case of the apparatus 17 for repairing molten metal degassing equipment published in the gazette, the repairing function can be lost due to the clogging of the material at the joint section between the rotating tube 19*a* and the impeller 18.

The present invention has been made in view of above-described circumstances and, accordingly, it is an object of this invention to provide a projecting construction method and apparatus for molten-metal-discharging hole and a projection impeller for concave section used in said apparatus for projection the projection material onto a concave section. It is thus possible to increase the material-projecting speed so as to improve the adhering force of the material. As the case may be, it is also possible to project the projection material (including refractory and other repairing materials) in the limited direction to enable an effective repair on a molten-metal-discharging hole having an eccentric or a partial wear. It is further possible to perform construction with high-adhesion and a fine structure at a conically-worn-out section (a concave section of a molten-metal-discharging hole) generated on the inside wall of a converter taphole.

SUMMARY OF THE INVENTION

The projecting construction method for molten-metal-discharging holes relating to the present invention with the object mentioned above comprises the steps of : inserting an impeller connected to a rotating power source for moving the impeller forward and backward in a molten-material-discharging hole, disposing before said impeller a material-supplying pipe for supplying projection material to the impeller using pressurized air or a pump, and projecting the projection material ejected from said material-supplying pipe onto a concave section of a molten-metal-discharging hole while changing the direction of the material with the impeller.

By the method of this invention, it is possible to have the projection material which is ejected out of the material-supplying pipe projected by the impeller near the periphery of the impeller. By increasing the rotating speed of the impeller, a high-speed projection of the material becomes possible and, as a result, a fine constructed layer can be obtained. When transferring the projection material by pressurized air, it is also possible to vent the air through the space between the vanes of the impeller. By this process, the projection material and the transferring air can be separated.

Then projecting construction apparatus for molten-metal-discharging holes relating to the first embodiment of the present invention incorporates an impeller which is connected to a rotating shaft, a stationary material-supplying pipe disposed before the impeller and having a ring-shaped port through which the transferred projection material is ejected, and a device to move the pipe and impeller forward and backward inside the molten-metal-discharging hole to be constructed.

The projecting construction apparatus for molten-metal-discharging hole relating to the second invention embodying the above-said method incorporates an impeller which is connected to a rotating shaft, and material-supplying pipes composed with two or more pipes which are disposed around said rotating shaft and eject the transferred material through the ports disposed before the impeller, and a device to move the pipe and impeller forward and backward inside the molten-metal-discharging hole to be constructed.

In the case of the projecting construction apparatus for molten-metal-discharging holes relating to the first and second invention mentioned above, it is possible to form a concave section before the impeller so that the top end section of each material-supplying pipe may come in the concave section. As a result, the projection material is surely projected by the impeller up to the periphery of the impeller in the radius direction even if the ejecting speed of the projection material is low.

Further, in the case of the projecting construction apparatus for molten-metal-discharging holes relating to the first and second inventions mentioned above, it is also possible to provide a cutter at the forward section of the impeller, and let the cutter rotate together with said impeller. As a result, it is possible to form a cylindrical molten-metal-discharging hole by cutting off the convex sections made of slat, etc. on the inside wall of the hole.

In addition, each vane of the impeller used in the projecting construction apparatus for molten-metal-discharging holes relating to above-mentioned first and second invention can be attached to the rotating shaft with a specified twisting angle relative to the rotating shaft so that the projection material supplied through the material-supplying pipe may be projected backwards and obliquely. Accordingly, it becomes possible to project the projection material nearly at a right angle to a conical-worn-out section on the inside wall of a molten-metal-discharging hole, that is the concave section generated on the molten-metal discharging hole. As a result, it becomes possible to construct a lined layer with high quality.

BEST MODE FOR CARRYING OUT THE INVENTION

Figure 1:
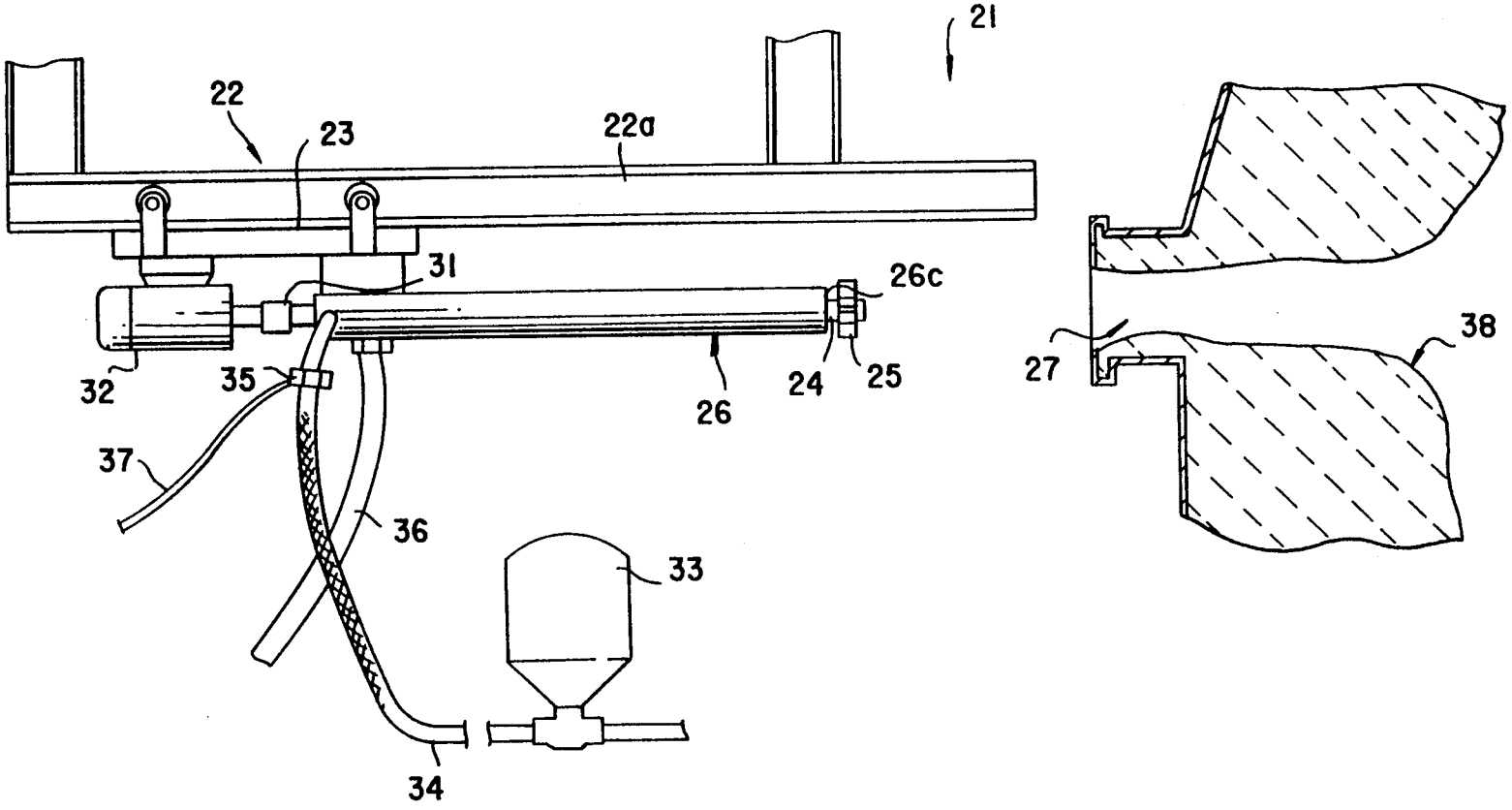
FIG. 1 is a side view showing the embodiment of the projecting construction apparatus for molten-metal-discharging holes relating to the first embodiment of the present invention.
Figure 2:
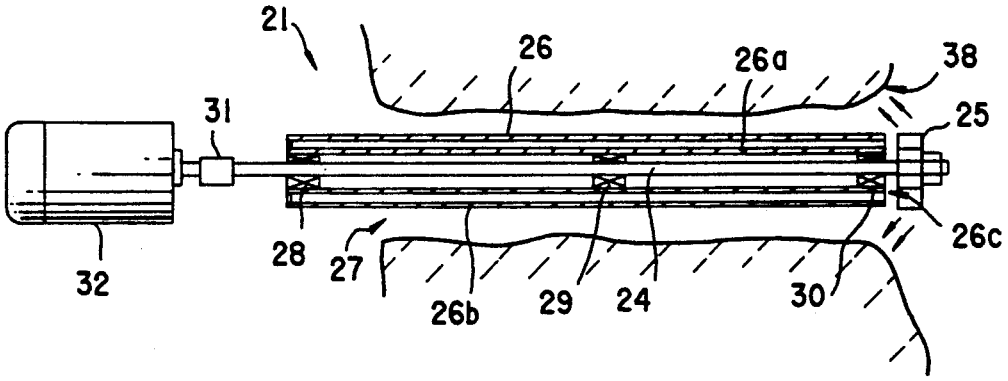
FIG. 2 is a diagrammatic sectional view showing the above-said apparatus for repairing molten-metal-discharging holes.

As illustrated in FIGS. 1 and 2, the apparatus 21 for repairing molten-metal-discharging holes relating to the first embodiment includes a travelling frame 22*a* which is supported by supporting members not shown in the figures but disposed before a converter taphole (one examples of a molten-metal-discharging hole) and a component of device 22 to move forward and backward, a travelling truck 23 having a driving source therein and that travels laterally on the above-said travelling frame 22*a*, a rotating shaft 24 so attached on the lower section of the travelling truck 23 via supporting member so as to rotate freely, an impeller 25 which is attached to the top end of the rotating shaft 24, and a material-supporting pipe 26 disposed around said rotating shaft 25. The details of these components will be described as follows.

As illustrated in FIG. i the above-side device 22 that moves forward and backward has a well-known composition wherein the travelling truck 23 moves forward and backward in parallel to the converter taphole 27, is driven by an electric motor, a hydraulic or a pneumatic cylinder, etc., and is guided by the travelling frame 22*a* which is supported by supporting members not shown in the figure. Here, though the travelling truck 23 has a composition only to move forward and backward. It is possible to add a well-known laterally-travelling or swinging function to the travelling truck 23 if required.

On the lower section of the travelling truck 23, the rotating shaft 24 is disposed vis supporting members. On the tope end of the rotating shaft 24, an impeller 25 is attached such that the impeller moves forward and backward inside the converter taphole 2*y* accompanying the movement of the travelling truck.

The impeller 25 is made with metal or ceramic vanes and. As illustrated in FIG. 2, at the center of the impeller 25, the rotating shaft 24 is attached. At the rear end section of the rotating shaft 24, a motor 32, which is the rotation driving source, is connected vis a coupling 31 so as to rotate the impeller 25 at high speed.

On the rotating shaft 24, bearings 28, 29 and 30 are disposed, so as to be fixed inside the supporting pipe 26*a*. On the outside of this supporting pipe 26*a*, there is disposed an outer cylinder 26*b* supported by supporting members not shown in the figure, wherein a ring-shaped material-supplying pipe 26 which is concentric with said rotating shaft 24 is formed by the outer cylinder 26*b* and supporting pipe 26*a*. The repair material (one of the example of projection material) is ejected toward the vases of the impeller 25 out of the ring-shaped port 26*c* at the top section of the material-supplying pipe 26.

At the starting end section of the material-supplying pipe 26 as illustrated in FIG. 1, a material-supplying hose 34 is connected which is also attached to a material-supplying tank 33. Transferred by the compressed air generated by a compressor not shown in the figure, the repairing material is ejected from the ring-shaped port 26*c* at the top section of the material-supplying pipe 26. On the material-supplying hose 34, there is disposed a water-adding device 35 which has water-injecting holes formed obliquely to the forward direction of the material flow so as to add the proper amount of water to the repairing material.

In addition, as another example, the water-adding device 35 may be attached at the end section of the outer cylinder 26*b*. In the figure, the number 36 shows a cooling water recirculation hose (not show in FIG. 2) for circulating the cooling water so as to cool the material supplying pipe. The number 37 shows the hose for supplying water to the water-adding device 35, and the number 38 shows the inside conically-worn-out section to be repaired.

In the actual use of the apparatus 21 for repairing molten-metal-discharging holes relating to the above-said first embodiment, since it has the function described above, the worn-out state of the converter taphole 27 is confirmed in advance. After circulating the coiling water used for the apparatus 21 and driving the rotating motor 32, the impeller 25 is inserted into the converter taphole 27 together with the material-supplying pipe 25 while controlling the travelling truck 23.

Then, using a compressor, etc., not shown in the figure, the repairing material in the material tank 33 is transferred by compressed air to the material-supplying pipe 26 through the material-supplying hose 34, and ejected toward the impeller 25 from the ring-shaped port 26*c* at the top section of the material-supplying pipe 26. Here, basic material such as the magnesia or dolomite is used as repairing material and proper amount of water is added via the water-adding device 35 disposed on the hose.

Since the impeller 25 rotates at high speed, the repairing material ejected onto said impeller 25 is projected by the vanes. As a result, as shown in FIG. 1, the converter taphole 27 is repaired quickly and, because of the projection that is nearly perpendicular to the surface to be repaired, a constructed layer finer than that by conventional methods can be obtained with good efficiency.

In the above described embodiment (same for the following second to fourth embodiments), a dry-type repairing material was used. The present invention, however, is suitable even for wet-type material (such as the above-mentioned magnesia or dolomite basic materials added with water, etc.) supplied by a pump, for example. Further, since the impeller is made up with plate-type vanes having open tops and a large part of the material-transferring compressed air flows in the same direction as that of the shaft axis, and since only the repairing material is projected by the vanes, the adhesion rate of the repairing material is improved. Clogging of material at the root of the vanes that occurs in conventional apparatuses as mentioned above is eliminated.

Moreover, by positioning the outer cylinder 26*b* of the material-supplying pipe 26 eccentrically to the supporting pipe 26*a* which supports the rotating shaft 24 of the impeller and, in addition, by giving proper rotation to the material-supplying pipe and changing the relative position of the port of the material-supplying pipe 26 to the molten-metal-discharging hole 27, it also becomes possible to eject the projection material eccentrically from the ring-shaped port 26*c* and to limit the projection of material from the impeller 25 to only one direction. By this modification the thickness of the circumference layer can be adjusted, and a partial concave section can also be repaired.

In this case, though the projecting position of the material-supplying pipe is to be controlled as it is rotated against the travelling truck, the material-supplying pipe becomes stationary when the impeller is used as a reference because the pipe does not rotate together with the impeller.

Then the details will be described as to the apparatus 39 and method for repairing molten-metal-discharging holes relating to the second embodiment illustrated in FIGS. 3 and 4. The same components in the FIGS. 1 and 2 for repairing molten-metal-discharging holes are provided with the same number and the description of these components are omitted.

Figure 3:
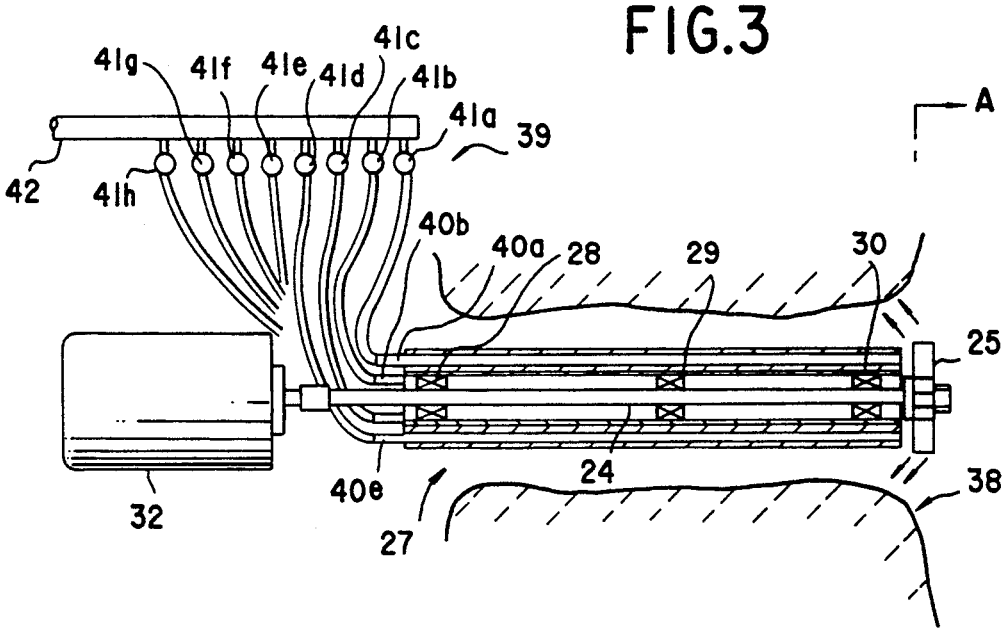
FIG. 3 is a diagrammatic side view of the apparatus for repairing molten-metal-discharging holes relating to the second embodiment of the present invention.
Figure 4:
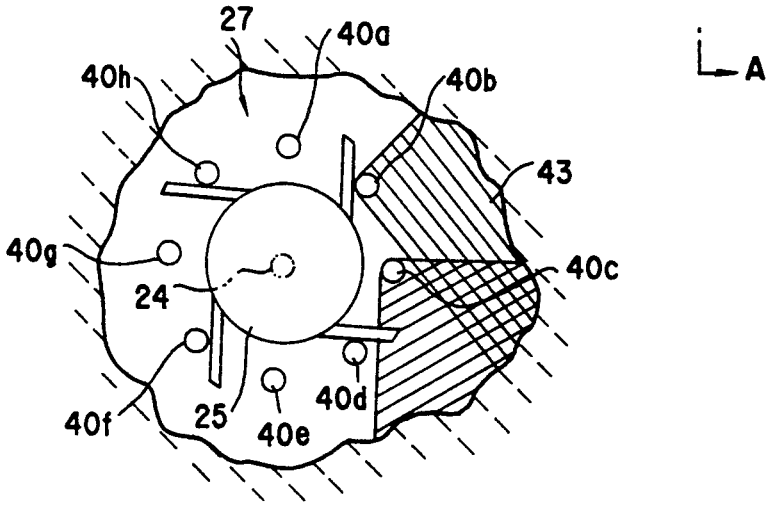
FIG. 4 is a diagrammatic enlarged view in the direction of the arrow A—A in FIG. 3.

In the apparatus 39 and method for repairing molten-metal-discharging holes as illustrated in FIGS. 3 and 4, the material-supplying pipes 40*a* through 40*h* composed of two or more pipes (eight pipes are used in this embodiment) are disposed around the rotating shaft 24. Each of the material-supplying pipes 40*a* through 40*h* is connected respectively to the centralized material-supplying pipe 42 via valves 41*a* through 41*h*. This centralized material-supplying pipe 42 is connected to the above-described material tank from which the predetermined repairing material, that is, one of the projection materials is transferred by compressed air.

Accordingly, as illustrated in FIG. 4 when there is partial wear 43 in a limited direction along the converter taphole 27 resulting from supplying the repairing material only from the material-supplying pipes 40*b* and 40*c*, the material can be projected in only one direction (the slanted lined portion in the right of FIG. 4). As a result, partial repair of the converter taphole becomes possible, because only a limited part of the material is ejected from the material-supplying port at the top end section of the pipe and collides with the impeller 25.

Further, in this embodiment, the repairing material is added with water beforehand and transferred by compressed air that is generated by a compressor not shown in the figure similar to the first embodiment mentioned hereinbefore. It is possible to provide a water-adding device to add the proper amount of water to the repairing apparatus on the material-supplying pipes 40*a* through 40*h* or upstream of them.

Figure 5:
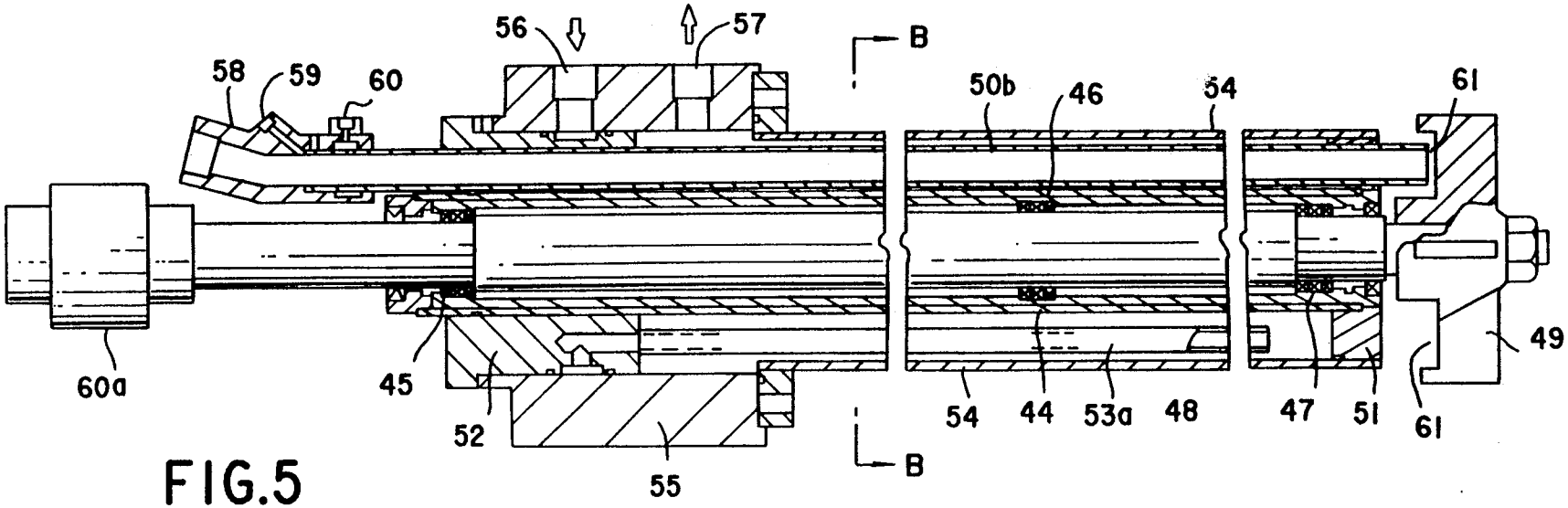
FIG. 5 is a sectional view with parts omitted of the major components of the apparatus for repairing molten-metal-discharging holes relating to the third embodiment of the present invention.
Figure 6:
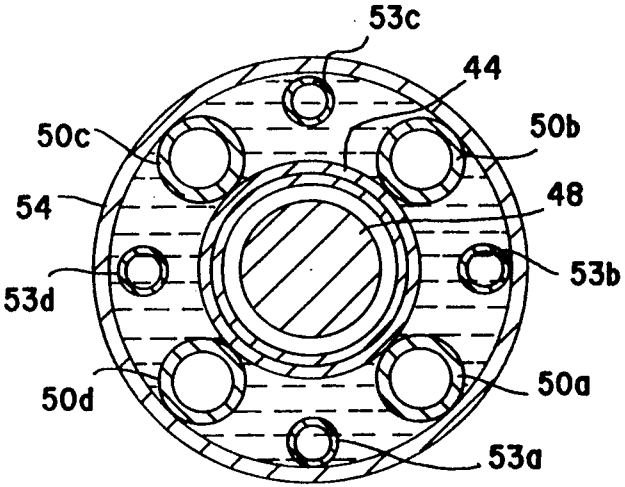
FIG. 6 is a sectional view of the direction of the arrow B—B in FIG. 5.

Then, in the main composition of the projecting construction apparatus for molten-metal-discharging holes relating to the third embodiment illustrated in FIGS. 5 and 6, a rotating shaft 48 formed to rotate freely is disposed via bearing 45, 46 and 47 on a supporting pipe 44 having sufficient length to be longer than the converter taphole. The impeller 49 is fixed on the top end of the rotating shaft 48.

As illustrated in FIG. 6, around the supporting pipe 44 are located material-supplying pipes 50*a* through 50*d* made with four stainless steel pipes with both ends being held with end plates 51 and 52. Between the material-supplying pipes 50*a* through 50*d*, cooling-water supplying pipes 53*a* through 53*d* are positioned. At the outer periphery of the material-supply pipes 50*a* through 50*d*, an outer cylinder 54 is located whose top end is fixed to the end plate 51 and whose bottom end is fixed to the supporting metal 55 which holds the end plate 52.

To this supporting metal 55, a water-supplying port 56 and a water-draining 57 are provided. The water-supplying port is connected to the four cooling-water supplying pipes 53*a* through 53*d*. The water-draining port 57 is connected to the inside of the outer cylinder 54, wherein the water supplied through the water-supplying pipes 53*a* through 53*d* to the top section of the material-supplying pipe 54, is drained out of the space between the supporting pipe 44 and the outer cylinder 54 and from the water-draining port 57. Here, FIG. 5 illustrates the state wherein no cooling water is supplied and, FIG. 6 illustrates the state wherein cooling water is supplied.

At each starting end section of the material-supplying pipes 50*a* through 50*d*, there is provided a connecting metal 58 to connect the material-supplying hose for transferring the repairing material (one example of projection material transferred) by compressed air and, at the connecting metal 58, there is provided an air-replenishing hole 59 for compensating the undersupply of compressed air, and a water-supplying hole 60 for supplying the water used for the repairing material. In addition, each of the material-supplied to the material-supplying pipes 50*a* through 50*d* can be stopped individually.

At the one end of the rotating shaft 48, there is provided a coupling 60*a* coupled with the output shaft of a rotation driving source (such as an electric motor, a hydraulic motor, or an air motor) not shown in the figure. A concave section 61 is formed before the impeller 49 which is fixed to the other end of the rotating shaft 48. The top end section of the material-supplying pipes 50*a* through 50*d* comes into the concave section so that the ejected repairing material may collide with the impeller 49 without failure and may be projected to the periphery of the impeller between the radius and circumference directions.

The supporting metal 55 is attached to the travelling truck 23 which is a component of the device 22 so that this apparatus may move forward and backward inside the converter taphole 27 accompanying the movement of the travelling truck 23.

Therefore, to use this projecting construction apparatus for molten-metal-discharging holes, the worn-out state of the converter taphole 27 to be repaired is first confirmed and the specified amount of water is supplied from the water-supplying port 56 so as to keep the inside sufficiently cool. Then, by driving the device 22 to move forward and backward, the apparatus is inserted up to the specified position inside the converter taphole 27 to be repaired. When the impeller 49 being rotated by a rotating motor, the valves connected to the material-supplying pipes 50*a* through 50*d* are opened so that the repairing material may be transferred by compressed air to one or two or all of the material-supplying pipes 50*a* through 50*d* described above.

During this process, the proper amount of water is added to the repairing material so as to make it wet. If so intended, it is possible to supply the repairing material to the vanes of the impeller 49 while increasing the ejecting speed by supplying the compressed air from the air-replenishing port 59.

The repairing material ejected from the material-supplying pipes 50*a* through 50*d* is projected by the impeller 49 to its periphery without failure whenever it is ejected even if the ejecting speed is not sufficient, because the top end of the material-supplying pipes 50*a* through 50*d* comes into the concave section 61 of the impeller 49. As a result, the repairing work becomes efficient.

Though this embodiment illustrates the case in which the multiple material-supplying pipes 50*a* through 50*d* are disposed around the rotating shaft, and, even in the case of the material-supplying pipe 26 composing the supporting pipe 26*a* and the outer cylinder 26*d* as in the aforesaid first embodiment, it is possible to let the top end section of the material-supplying pipe come into the concave section 61. Accordingly, the apparatus still has the characteristics that the repairing material is to be well projected by the impeller even if the ejecting speed of the supplied material is low.

Figure 7:
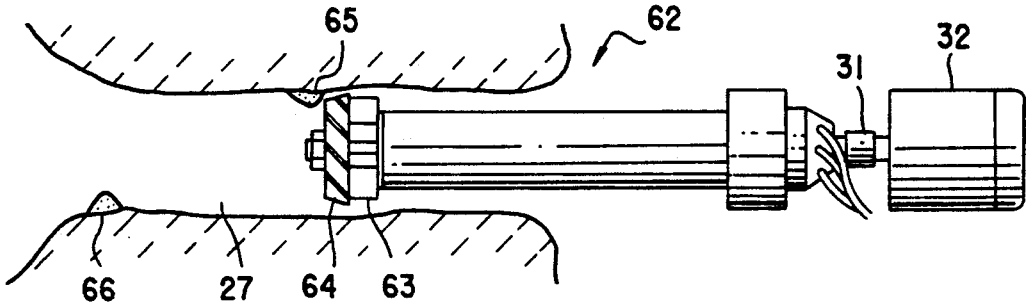
FIG. 7 is a diagrammatic side view of the projecting construction apparatus for molten-metal-discharging holes relating to the fourth embodiment of the present invention.
Figure 8:
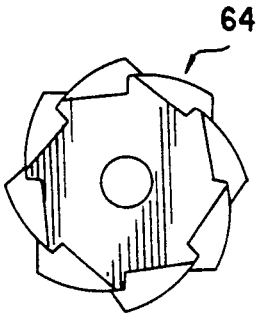
FIG. 8 is a front view of a cutter used in the above-said fourth embodiment.
Figure 9:
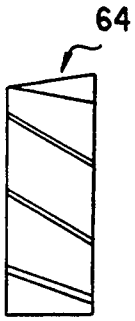
FIG. 9 is a side view of the same.

Then, the basic difference between the apparatus 62 for repairing molten-metal-discharging holes relating to the fourth embodiment illustrated in FIGS. 7, 8, and 9, and the above-said apparatus for repairing molten-metal-discharging holes is that the apparatus 62 for repairing molten-metal-discharging holes is provided with a detachable cutter 64 at the forward section of the impeller 63 as illustrated in FIGS. 8 and 9. Accordingly, the cutter 64 rotates accompanying the rotating impeller 63. By this mechanism, it becomes possible to remove the convexes 65 and 66 inside the converter taphole 27 before repairs are actually made. Moreover, in case of overprojection in one direction of the repairing material (one example of a projection material), it is also possible to cut away the overprojected material by use of the cutter 64.

Figure 10:
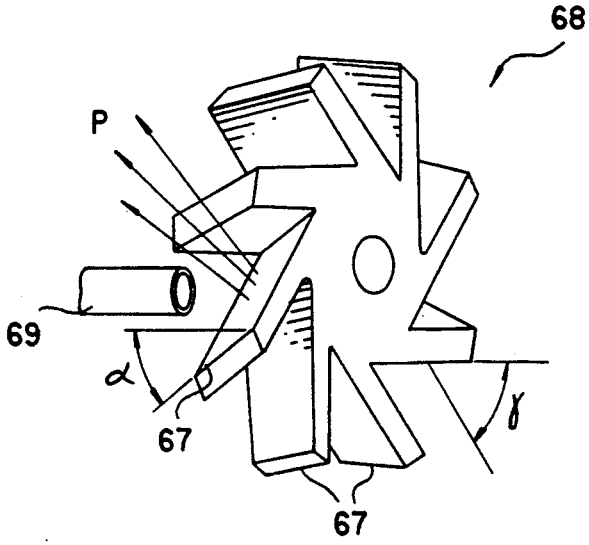
FIG. 10 is an oblique view of the impeller relating to the other embodiments used in the above-said projecting construction apparatus for molten-metal-discharging holes.
Figure 11:
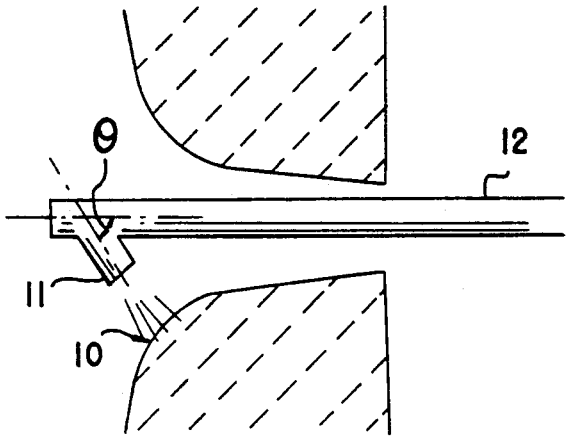
FIG.11 PRIOR ART
FIG. 11 is a diagrammatic side view showing the method of repairing molten-metal-discharging holes relating to a conventional practice.
Figure 12:
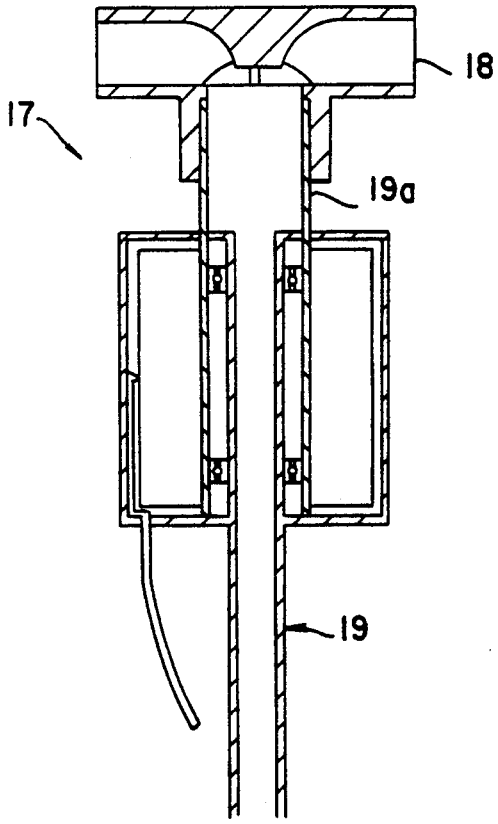
FIG.12 PRIOR ART
FIG. 12 is a sectional view of a repairing apparatus using an impeller relating to a conventional practice.

FIG. 10 illustrates an impeller 68 to which each vane 67 of the impeller is attached with a twisting angle (insert alt a) to the rotating shaft (not shown) and with an inclination (insert alt t) to the direction of rotating radius. By attaching each vane 67 of the impeller with the twisting angle to the rotating shaft as described above, it is possible to project the repairing material (one example of projection material) backward obliquely as shown by the arrow P relative to the impeller 68 from the material-supplying pipe 69. By attaching each vane with an inclination to the direction of the rotating radius, it is also possible to take an angle to project the repairing material nearer the rotating shaft.

Accordingly, when repairing the conically-worn-out section 38 inside the converter as shown in FIG. 2, an extremely efficient projection becomes possible by projecting the repairing material, with the impeller 68 being set a little ahead of the worn-out section, because the repairing material is projected backward obliquely.

Though the above-described embodiment is for the repair of the internal portions of a converter taphole, the present invention has many applications such as for the repair of concave noses and electric furnace throats (inserting hole), and of ceramic-producing kilns in which the material-flowing-direction is changed. Further, the present invention is applicable not only for repair but also to the construction and forming work at the critical section of converters, etc. by use of castable refractors.

In the repairing method for molten-metal-discharging holes relating to the present invention, it has become possible to project the projection material effectively onto the concave section of a molten-metal-discharging hole while passing the transferring air, etc. along the direction of rotating axis, because the projection material supplied through the material-supplying pipe and ejected to the impeller is projected in the peripheral direction by collision with the vanes of the impeller rotating at high speed.

Accordingly, the present invention enables repair work in hot sates with high efficiency, without material clogging, and to produce a high-quality lined layer even if the conical section inside a molten-metal-discharging hole is difficult to project repairing material using conventional methods.

Further, the apparatus for repairing molten-metal-discharging holes relating to the first and second inventions can provide an apparatus embodying the above-described method, enabling high-speed projection of material onto the inner wall of molten-metal-discharging holes, and, as a result, make it possible to install an inner wall with high-bulk-density (low-porosity).

Especially, in the case of an apparatus for repairing molten-metal-discharging holes relating to the second invention, it is possible to eject the projection material in one concentrated direction by disposing a valve to each material-supplying pipe. As a result, it becomes possible to adjust the thickness of the circumference layer and so repair efficiently the molten-metal-discharging hole, thereby contributing to a decrease in the unit cost of the repairing material.

Moreover, because it is possible to repair the molten-metal-discharging hole to a true circular shape, the air-contacting area of the flow molten metal is decreased and, steel quality improves.

In the projecting construction apparatus for molten-metal-discharging holes relating to above-described first or second invention, it is possible to reliably project projection material by use of the impeller even if the ejecting speed of the material is low, by forming a concave section before the impeller and by making the top end of the material-supplying pile come into the concave section.

Also, in the projecting construction apparatus for molten-metal-discharging holes relating to the above-said first and second inventions, by providing a cutter to the impeller, it becomes possible to remove the convexes and overprojected material which exit on the inside wall of a molten-metal-discharging hole. As a result it further becomes possible to form or repair the molten-metal-discharging hole into a true circle.

In addition, the impeller of the present invention for repairing the concave section of molten-metal-discharging holes can project the projection material backward obliquely. Accordingly, more efficient projection can be performed to the conically-wornout section on the inside wall of a molten-metal-discharging holes. Therefore, by using the projection repairing method with the impeller of the present invention in the repair of a converter taphole, it becomes possible to repair a molten-metal-discharging hole while a converter is in a blowing process.

We claim:

1. An impeller used in a projecting construction apparatus for a concave section of a molten-metal-discharging hole, said impeller being supported on a rotating shaft for redirecting flow of impinging projection material, comprising:

a plurality of vanes which are attached to said rotating shaft with a specified twisting angle relative to said rotating shaft, and a material-supplying pipe being directed upon said plurality of vanes in a predetermined direction, so that, upon impingement of said projection material from said material-supplying pipe upon said plurality of vanes in said predetermined direction, said projection material is projected outwardly towards said concave section of said discharging hole and in a direction nearly opposite to said predetermined direction of impingement of said projection material supplied through said material-supplying pipe by said impeller having said plurality of vanes attached to said rotating shaft with said specified twisting angle relative to said rotating shaft.

* * * * *